US009650767B2

(12) United States Patent
Nightlinger et al.

(10) Patent No.: US 9,650,767 B2
(45) Date of Patent: May 16, 2017

(54) SINK FAUCET ASSEMBLY

(71) Applicants: Scott Anthony Nightlinger, Arlington Heights, IL (US); Grzegorz Loniewski, Mount Prospect, IL (US)

(72) Inventors: Scott Anthony Nightlinger, Arlington Heights, IL (US); Grzegorz Loniewski, Mount Prospect, IL (US)

( * ) Notice: Subject to any disclaimer, the term of this patent is extended or adjusted under 35 U.S.C. 154(b) by 320 days.

(21) Appl. No.: 14/166,761

(22) Filed: Jan. 28, 2014

(65) Prior Publication Data

US 2014/0215709 A1 Aug. 7, 2014

Related U.S. Application Data

(60) Provisional application No. 61/759,908, filed on Feb. 1, 2013.

(51) Int. Cl.
*E03C 1/04* (2006.01)

(52) U.S. Cl.
CPC ..... *E03C 1/04* (2013.01); *E03C 2201/40* (2013.01)

(58) Field of Classification Search
CPC ..... E03C 1/04
USPC ..... 4/675–678, 300–442
See application file for complete search history.

(56) References Cited

U.S. PATENT DOCUMENTS 2,042,106 A 5/1936 Knight
5,126,041 A 6/1992 Garrison
5,417,348 A 5/1995 Charters
5,510,031 A 4/1996 Knauf
5,656,160 A 8/1997 Parise
5,685,981 A 11/1997 Koslow
5,983,938 A 11/1999 Bowers
6,024,867 A 2/2000 Parise
6,029,699 A 2/2000 Granot
6,145,670 A * 11/2000 Risser ..... C02F 1/003 210/282
6,179,130 B1 1/2001 Nguyen
6,464,871 B1 10/2002 Chang
6,532,982 B2 3/2003 Downer
6,641,727 B1 * 11/2003 Aldred ..... B01D 35/04 210/232
6,941,968 B2 9/2005 Vidal
7,077,153 B2 * 7/2006 Segien, Jr. ..... E03C 1/04 137/119.01
7,354,513 B2 4/2008 Nightlinger et al.
7,607,449 B2 10/2009 Herring
8,317,110 B2 * 11/2012 Aoyagi ..... G05D 23/1393 137/624.11
2010/0089472 A1 4/2010 Meza

* cited by examiner

*Primary Examiner* — Lori Baker
(74) *Attorney, Agent, or Firm* — John C. Shepard

(57) ABSTRACT

A sink faucet assembly that includes a sink faucet and a filter faucet combined together into a single unit. The sink faucet is of the single-handle type for mixing hot and cold water and includes a body member, base, or escutcheon mount upon which the filter faucet is attached. The filter faucet includes a faucet body and spout that may dispense filtered water from an undersink filter and it may further include a water filter fluidly disposed between the faucet body and spout. A filter replacement kit is provided in an embodiment that includes a generally inline water filter, an optional water spout, and an elongated hollow tubular stem adapter attachable to the filter faucet body in a generally push-in manner.

18 Claims, 8 Drawing Sheets

SINK FAUCET ASSEMBLY

CROSS-REFERENCE TO RELATED APPLICATIONS

This application incorporates by reference and claims priority to U.S. Provisional Patent Application No. 61/759,908 filed Feb. 1, 2013.

BACKGROUND OF THE INVENTION

This invention relates generally to the functional combination of a sink faucet and a water filter faucet generally utilized at a kitchen sink.

The modern residential kitchen often includes more water-using fixtures than before. Such fixtures may include a sink faucet, a sink sprayer, a semi-boiled water dispenser, a filtered water dispenser and/or a countertop or faucet-mount water treatment device. Each fixture usually requires its own space, which can clutter valuable workspace at the kitchen sink.

Water treatment devices of the prior art designed for use on or above the sink surface or countertop are mostly complex and expensive devices with requirements for installation and periodic filter element replacement being intimidating for those users not mechanically inclined. Embodiments intended to reduce complexity have created sinktop nuisances involving faucet spout mounted filters, faucet spout mounted diverter valves with tubing, complex and costly bases with large footprints on the sink or countertop, and inefficient filter elements with short lifespans requiring relatively frequent replacement.

Water filter devices comprising a permeable filter element or cartridge designed for insertion within a watertight housing are taught in U.S. Pat. Nos. 2,042,106; 5,126,041; 5,510,031; 5,656,160; 5,685,981; 5,983,938; 6,024,867; 6,464,871; 6,532,982; and 6,641,727. These filter devices require a complex housing for the filter element wherein water flows around and through the filter. These housings are watertight, in which several remain pressurized and full of water when not in use. All of these housings see at least some water pressure and must remain watertight. Thus increasing design requirements, manufacturing costs, and the potential for leaks. When not in use, water stagnates within the filter housing developing bacterial slime that accumulates over time beyond the lifespan of a single filter element. This bacterial slime decreases the lifespan of the filter while simultaneously mixing with the treated water that is consumed. The standing water overflows and spills when the filter element is replaced and the housing interior requires cleaning to remove the accumulated bacteria. The bacterial slime accumulation requiring cleaning and water spillage associated with filter element replacement makes the task unpleasant and often unintentionally serves to discourage filter replacement, further leading to postponing the task, resulting in increased bacterial growth and consumption. Thereby minimizing the otherwise significant benefits of owning and using a water filter.

A water filter combined with a sink faucet is shown in U.S. Pat. No. 5,510,031 by Knauf and U.S. Pat. No. 6,179,130 by Nguyen. The faucet filter taught by Knauf possesses the design and manufacturing inefficiencies mentioned above in relation to a watertight housing for a filter element. Further, Knauf teaches a device having a large footprint on the sink surface requiring a significantly large custom hole that is difficult and costly to make while also increasing the potential for water leakage. Filter replacement requires removing a significantly large and clumsy spout top cover. Nguyen teaches an extremely complicated, costly, and custom faucet spout containing a filter therein. The Nguyen filter similarly being of special design that increases cost while decreasing availability. Both Knauf and Nguyen teach filter faucets that direct hot water through the water filter even though hot water is known to damage some types of water filter media and may even introduce dangerous bacteria from an improperly set hot water heater. Additionally, water pressure normally provided at the sink faucet is too high for some types of filter media and may create water channels when flowing through the media. Thereby allowing water to flow through without being filtered, completely eliminating the advantages of having the filter.

The filter faucets provided in U.S. Pat. Nos. 6,532,982; 6,641,727; 6,941,968; and U.S. Application Publication US 2010/0089472 A1 improve upon the disadvantages taught by Knauf and Nguyen by separating the faucet and water supply structure from the sink faucet spout. Each of these shows a filter residing below the countertop that remains accessible from above the countertop for replacement purposes. Each requires structural disassembly or removal of the top portion or spout to replace the filter. Most of these carry over the problems described previously pertaining to a pressurized and watertight filter housing. The slim design being too small for a user's hand to clean the accumulated bacterial slime from within the housing. While the design is slim, it still requires a minimum of about a 1.5-2.0 inch diameter hole in the countertop that is non-standard, must be custom made, must be sealed, and increases the potential for water leakage. All of these require inefficient and custom construction that in most cases is complex and involves costly manufacturing processes for unique and non-standard components. Further, these introduce the potential of water leakage under the sink that may easily go unnoticed by the user feeling secure in having a filtration device accessible from above the sink surface while the main body, water compartment, and water connections remain under the counter.

U.S. Pat. Nos. 5,417,348, 6,029,699, and 7,607,449 disclose a water tap capable of dispensing filtered water, besides the regularly mixed hot and cold water. These water taps teach extremely complex structures, require the filter be installed under the counter, and prevent filtered water being drawn from the faucet at the same time as the regularly mixed hot and cold water.

BRIEF SUMMARY OF THE INVENTION

Accordingly, it is a primary objective of the present invention to provide an improved sink faucet assembly that corrects and overcomes the disadvantages of the prior art.

It is a secondary objective of the present invention to combine the generic sink faucet with a countertop water filter faucet in a single unit that is simple, durable, inexpensive in construction, and consumes the same amount of countertop sink space as the generic sink faucet while concurrently providing both hot and cold mixed water from the sink faucet and filtered water from the filter faucet.

It is a tertiary objective of the present invention to provide an improved inline filter cartridge as a modular, watertight, and disposable component of a water filter faucet that is readily replaceable without tools or water spillage.

It is a quaternary objective to utilize a generic countertop dispensing faucet typically for undersink water filter systems, having a faucet body comprising a flow control valve and a water outflow port typically for direct coupling with a spout, for new use as a faucet body for the water filter faucet. Thereby decreasing manufacturing costs and increasing component interchangeability due to the utilization of standard and readily available components.

The present invention provides a sink faucet assembly that generally combines a common single-handle sink faucet with a water filter faucet. A generic sink faucet may be configured for one, two, or three standard holes in the countertop. The sink faucet generally includes a body that comprises a base, a valve, a valve or faucet body, a valve handle, a water discharge spout, and a means for receiving a water supply. The sink faucet base may be alternatively defined as a deck, escutcheon mount, or mounting plate. In an embodiment, a water filter faucet may be combined with the sink faucet body. In another embodiment, the water filter faucet may be attached to the sink faucet escutcheon mount. The water filter faucet generally includes a faucet body, a valve, a water filter, a faucet spout, and a means for receiving a water supply. Several variations of sink faucets and filter faucets may be used, in which a few are shown and described herein.

A water dispensing faucet may be optionally included in place of or in addition to the filter faucet. The water dispensing faucet may dispense filtered water from an under-counter water filtration or treatment system, or the dispensing faucet may be alternatively used to dispense semi-boiled water from an under-counter water heating system. In another embodiment, the water dispensing faucet may be optionally configured as having one or two spouts and two valves, one valve for controlling hot water and the second valve for controlling filtered water.

A sink sprayer may be optionally mounted on the sink faucet escutcheon mount.

The improved sink faucet assembly frees the sink countertop space normally consumed by the sprayer, the water dispensing faucet, and the water filter device; whether the filter device is mounted on the countertop or is of the faucet mount type hanging off the sink faucet spout.

Common and low-cost watertight and modular inline filters having appropriate modifications may be used having a greater filtering capability and lifespan than smaller faucet mounted filter cartridges.

The filter cartridge may be quickly and easily replaced, or removed and stored in a refrigerator when not in use. Thus decreasing bacterial growth within the filter cartridge and spout.

The improved sink faucet assembly makes efficient use of the standard multiple hole pattern provided in typical sinks and countertops without requiring the need to drill additional holes or to widen the holes available; of particular advantage with modern granite surfaces or similar.

Installation of the improved faucet assembly as a single unit requires less space, fewer parts, decreases the overall cost, and provides a filter cartridge that is readily replaceable.

Additional objects, features, and advantages will become apparent from the following description and appended claims.

BRIEF DESCRIPTION OF THE SEVERAL VIEWS OF THE DRAWING

The features of the present invention will become more readily apparent and further understood by reference to the following drawings.

Sheet 1.

Sheet 2.

Sheet 3.

Sheet 4.

Sheet 5.

Sheet 6.

Sheet 7.

Sheet 8.

Sheet 8.

PART NUMBERS OF THE DRAWINGS

Figure 1:
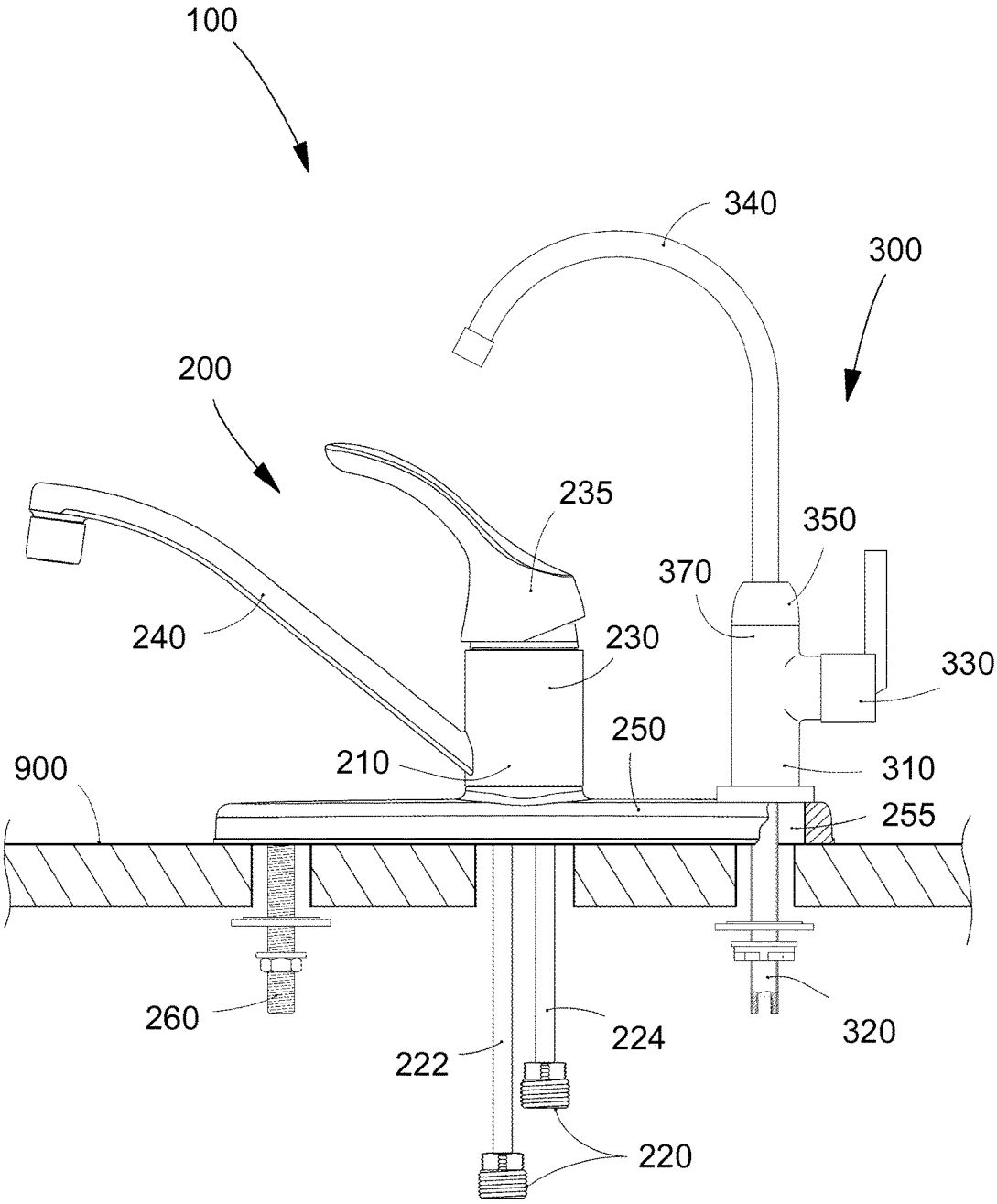
FIG. 1 is an elevational schematic view of a sink faucet assembly including a water filter faucet, according to the invention.

100 sink faucet assembly
**100*a*** sink faucet assembly
**100*b*** sink faucet assembly
**100*c*** sink faucet assembly
**100*d*** sink faucet assembly
**100*e*** sink faucet assembly
**100*f*** sink faucet assembly
200 sink faucet
**200*a*** sink faucet
**200*b*** sink faucet
**200*c*** sink faucet
210 sink faucet body
**210*a*** sink faucet body
**210*b*** sink faucet body
**210*c*** sink faucet body
220 water supply connection fittings
222 hot water supply line
224 cold water supply line
225 sink sprayer water supply fitting
230 water mixing valve
**230*a*** water mixing valve
235 sink faucet handle
240 sink faucet spout
**240*a*** sink faucet spout
250 sink faucet base
**250*a*** sink faucet base, escutcheon
**250*b*** sink faucet base, escutcheon
**250*c*** sink faucet base, escutcheon
255 opening in sink faucet base
260 fastening stud
265 sink faucet shank
270 fastening nut
300 water dispensing faucet
**300*a*** water filter faucet

300*b* water filter faucet
300*c* water filter faucet
300*d* water filter faucet
300*e* water filter faucet
310 filter faucet body
310*a* filter faucet body
310*b* filter faucet body
310*c* filter faucet body
310*d* filter faucet body
310*e* filter faucet body
310*f* filter faucet body
311 sealing surface
320 faucet shank, fitting
325 fastening nut
330 valve
340 spout
340*a* spout
340*b* spout
340*d* spout
340*e* spout
340*f* spout
341 spout inlet end
350 cap
360 threaded pipe nipple
370 filter faucet body outflow port
375 socket fitting
400 water filter cartridge
400*a* water filter cartridge
400*f* water filter cartridge
410 filter inflow port
410*d* filter inflow port
410*f* filter inflow port
415 inflow port outer surface
416 self sealing surface
417 tubular stem
418 seal
419 seal groove
420 filter outflow port
420*d* filter outflow port
420*f* filter outflow port
420*a* filter outflow port
421 push-to-connect fitting
425 inner abutment
430 watertight shell
440 water treatment media
450 decorative cap
460 stem adapter
461 proximal end
462 distal end
463 surface
464 sealing ring
465 fluid conduit
500 sink sprayer
550 seat, escutcheon
560 sprayer shank, threaded
570 fastening nut
900 mounting surface

DETAILED DESCRIPTION OF THE INVENTION

The present invention generally relates to a kitchen faucet assembly that combines a sink faucet and a filtered water delivery device. Exemplary embodiments of the inventive faucet assembly are shown in FIGS. 1-7, according to the invention. In general, each embodiment includes a sink faucet and a water filter faucet joined together as a single unit. Accordingly, the forthcoming description is to be construed as illustrative rather than limiting.

Referring to the drawings wherein like numerals refer to like parts, FIG. 1 illustrates an exemplary embodiment of a sink faucet assembly 100. The sink faucet assembly 100 may comprise a generic single-handle sink faucet 200 and a water dispensing faucet 300. In the embodiment, the sink faucet 200 is shown having a common three-hole mounting configuration. The sink faucet assembly 100 may be operatively mounted on a generally horizontal mounting surface 900 that may be part of a sink or countertop. In accordance with conventional construction, the sink faucet 200 includes a mounting base 250 and a faucet body 210 integrated with or attached to the mounting base 250. The mounting base 250 may be alternatively referred to as a deck, escutcheon mount, mounting plate, or broadly as part of the faucet body 210 or as a body member. The faucet body 210 includes a water mixing valve generally designated by 230 disposed therein, an optional valve handle 235, and a water spout 240 that may be pivotable or swivable about a vertical axis. The valve 230 may control the water flow rate and hot and cold water mixing ratio by operating the handle 235. Hot and cold water supply conduits, 222 and 224 respectively, extend below from the faucet body, flow through which is controlled by the water mixing valve 230 housed in the faucet body. Water connection fittings 220 are provided on the hot and cold water supply conduits 222 and 224 for connecting to the residential water supply, typically provided under the sink. A threaded fastening stud 260 is attached to the underside of the faucet base 250 for fastening the sink faucet 200 to the mounting surface 900. An optional configuration of the single-handle sink faucet 200 may be in the form of a pull-out spray head faucet having a spray head that may be extended or pulled out from the spout as is common in modern faucet designs. For example, as the faucet designs shown in U.S. Pat. Nos. 5,934,325 and 6,220,297.

In accordance with the improvement shown in FIG. 1, the combined faucet assembly 100 further includes a countertop water dispensing filter faucet 300 which may be integrally joined with or removably attached to the sink faucet base 250 through an opening 255 therein. The water dispensing filter faucet 300 includes a body 310, within which is housed a water flow control valve generally designated by 330 and a water discharge spout 340 attached and fluidly engaged with the faucet outlet 370 and optionally secured by a cap 350. A hollow faucet shank 320 is attached to the underside of the filter faucet body 310 and through the sink faucet base opening 255 for providing a fluid flow conduit, a means for fastening to the underside of the mounting surface 900, and a means for connecting to a filtered water supply line (not shown) separate from the cold water supplied to the sink faucet 200. The means for fastening to the underside of the mounting surface 900 is shown to include the hollow faucet shank 320 having external threads for corresponding with a fastening nut and washer (not indicated), and may be in other forms desirable for fastening the combined faucet assembly 100 to the mounting surface 900. The means for connecting to a filtered water supply line at the end of the hollow faucet shank 320 may be an externally threaded fitting for a compression connection with a water supply connector or any fitting similarly suited for the purpose, for example a push-to-connect fitting for connecting with plastic tubing. The manually operated valve 330 (not shown in detail) being generally disposed within the faucet body 310, controls the water flow through the water discharge spout 340. The valve may be operated by any desirable means, including for example a sensor and/or a solenoid. The water dispensing filter faucet 300 may also be configured as having an air-gap or open-relief design taught, for example, in U.S. Pat. Nos. 7,017,600, 7,353,838, or 7,743,788.

It is understood for those skilled in the art that FIG. 1 may alternatively depict a kit of parts connectedly arranged for a sink faucet assembly 100 according to the invention, which includes a single-handle water-mixing sink faucet 210 combined with the escutcheon mount 250, and a water filter faucet 310.

Figure 2:
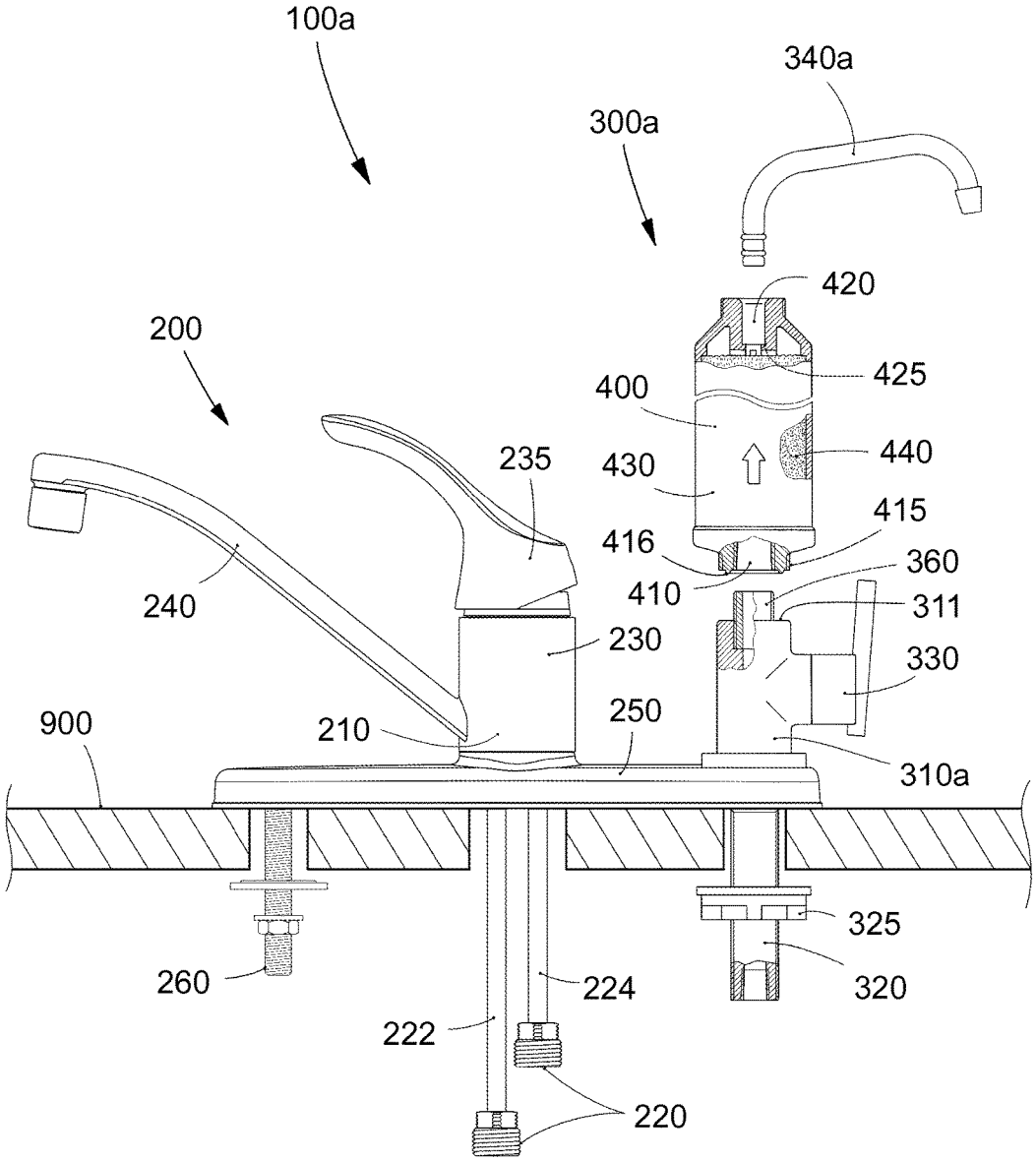
FIG. 2 is an elevational schematic view of a sink faucet assembly having a water filter faucet that includes a filter, according to the invention.

FIG. 2 illustrates another exemplary embodiment of the inventive sink faucet assembly generally denoted by 100*a*. The sink faucet 200 is identical to that described and shown in FIG. 1. The water dispensing filter faucet 300*a* attached to the sink faucet base or escutcheon 250 is configured to support the additional provision of a modular and disposable inline water filter cartridge 400. The filter faucet body 310*a* may be made of plastic and is similar to the filter faucet body 310 described in FIG. 1 with the cap 350 removed to show an externally threaded pipe nipple 360 inserted therein. The threaded pipe nipple fitting 360 may facilitate and simplify the connection of the inline water filter cartridge 400 to the faucet body 310*a*. The hollow faucet shank 320 may be integrally made with the faucet body 310*a* and is shown provided with a larger diameter than that shown in FIG. 1 to better support the increased size and mass of the filter faucet 300*a*, which incorporates the inline filter cartridge 400. The faucet shank 320 is shown accompanied by a correspondingly larger internally threaded plastic nut 325 for securely fastening the faucet assembly to the mounting surface 900. Other means desirable for fastening the water faucet assembly 100*a* to the mounting surface 900 may be provided without departing from the spirit and scope of the invention.

The disposable inline water filter cartridge 400 may be generally similar to the type provided by the Omnipure CL-series and K-series filters, with modifications to the inlet and outlet portions. This type of filter has a watertight shell 430 typically of plastic material comprising a generally cylindrical construction about a central longitudinal axis (not shown) with a first end and a second end. The first end has a fluid inflow port 410 and the second end has a fluid outflow port 420. A partial cutaway view of the watertight shell 430 shows the water treatment media 440 contained therein. The water treatment media 440 being exemplified as granulated activated carbon that may be replaced by other desired types of water filtering or treatment material known in the art. The filter cartridge fluid inflow port 410 may have self-sealing internal threads that form a watertight connection with the filter faucet threaded pipe nipple fitting 360, as shown. The inflow port 410 may also optionally include a self-sealing contact surface 416 for watertight engagement with the faucet body sealing surface 311 that may also be used to assist in supporting the filter cartridge 400. The filter cartridge fluid outflow port 420 may have a socket configuration for receiving the spout 340*a* for directing water outflow. The fluid outflow port 420 socket configuration may have an inner shoulder 425 for stopping and supporting the faucet spout 340*a* when operatively inserted.

It is understood for those skilled in the art that FIG. 2 may alternatively depict a kit of parts connectedly arranged for a sink faucet assembly according to the invention, which includes a single-handle water-mixing sink faucet 200 combined with the escutcheon mount 250, and a water filter faucet 300*a* having a filter in the form of a disposable inline water filter 400.

Figure 3:
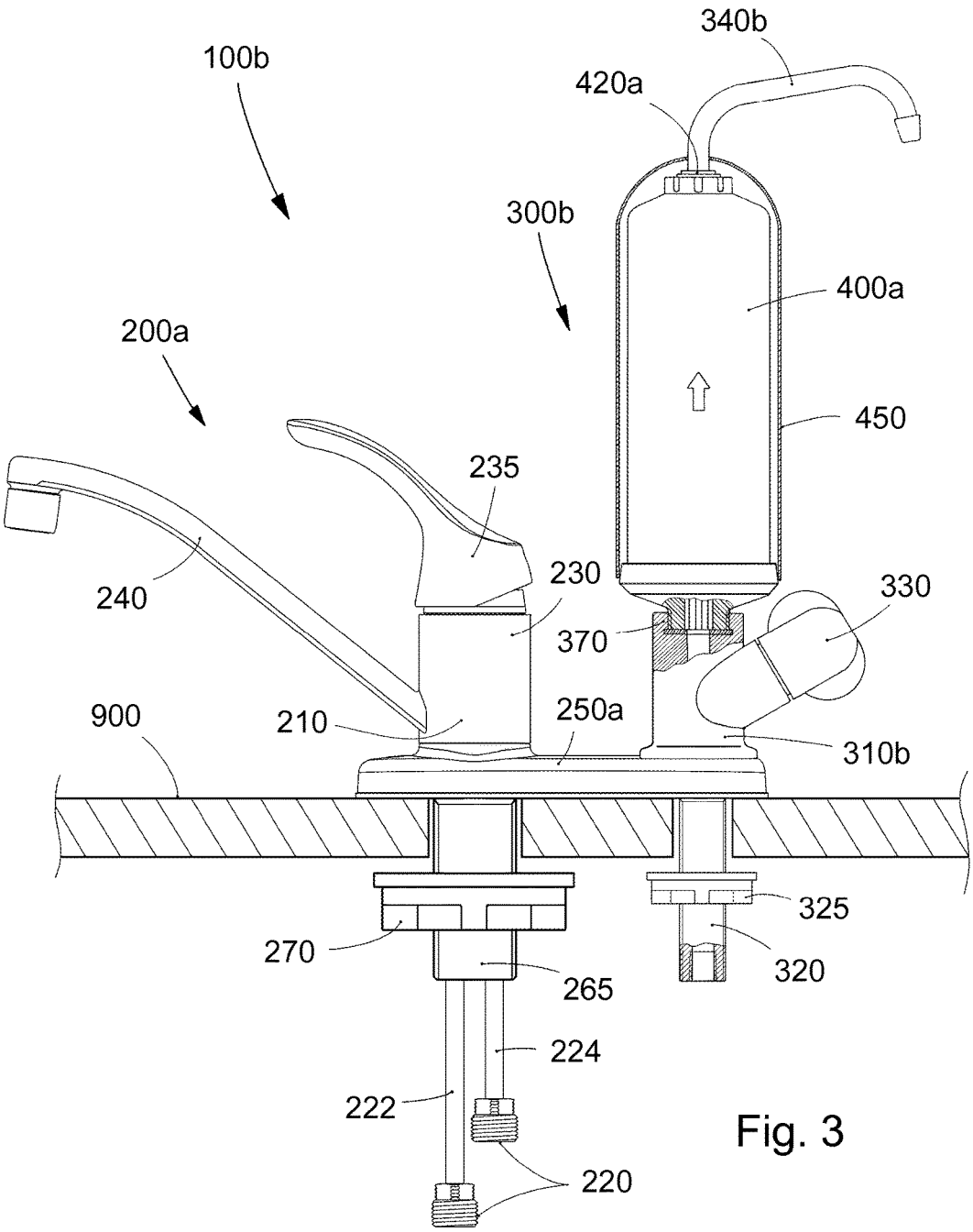
FIG. 3 is a schematic view of an alternative sink faucet assembly including an alternative filter faucet according to the invention.

In FIG. 3, the improved sink faucet assembly generally designated by 100*b* is shown having a two-hole mounting configuration. The embodiment includes an escutcheon mount 250*a* configured to support and hold in place a kitchen sink faucet 200*a*, and a second faucet 300*b* configured as a filter faucet. The sink faucet 200*a* and the filter faucet 300*b* may be removably attached to the escutcheon mount 250*a*. In assembly, the sink faucet 200*a* and the filter faucet 300*b* are individually mounted through the escutcheon 250*a* to a horizontal mounting surface 900, which may comprise part of a sink or an adjacent countertop. In accordance with conventional construction, the single-handle kitchen sink faucet has the faucet body 210 similar as shown and described in FIGS. 1 and 2. The sink faucet as shown includes a threaded shank 265 attached to the underside of the faucet body 210 for fastening the sink faucet 200*a* through the escutcheon 250*a* to the mounting surface 900. A corresponding internally threaded plastic nut 270 is provided on the shank 265 to secure the threaded connection. Other means desirable for fastening the sink faucet assembly to the mounting surface 900 may be provided without departing from the spirit and scope of the invention.

Water is supplied to the sink faucet 200*a* in a conventional manner via hot and cold water conduits 222, 224 extending from underneath the faucet shank 265, identical as shown in FIGS. 1 and 2. The filter faucet 300*b* incorporated in the improved sink faucet structure 100*b* is fixed to the mounting surface 900 through the escutcheon 250*a* in an identical manner as the sink faucet 200*a* or the filter faucet assembly 300*a* shown in FIG. 2. The filter faucet assembly 300*b* may also be referred to as a water treatment assembly and may include in combination a filter faucet body 310*b*, a disposable inline water filter 400*a*, and a water spout 340*b*. The filter faucet body 310*b*, which is similar to the body 310*a* shown in FIG. 2 has a female socket fitting 370 with internal threads and a washer (not indicated) for cooperative engagement with the filter 400*a* threaded inlet end. The connection between the faucet body and the filter inlet end may be in other cooperative forms, for example, a bayonet fitting or as shown in the embodiment in FIG. 2. The filter inlet is correspondingly configured for watertight engagement with the filter faucet body 310*b* socket fitting 370. At the opposite end, the filter outlet 420*a* is shown having a common push-to-connect tube fitting in which the water spout 340*b* is inserted. For aesthetic purposes, a decorative cap 450 may be placed over the plastic filter cartridge 400*a*.

Figure 4:
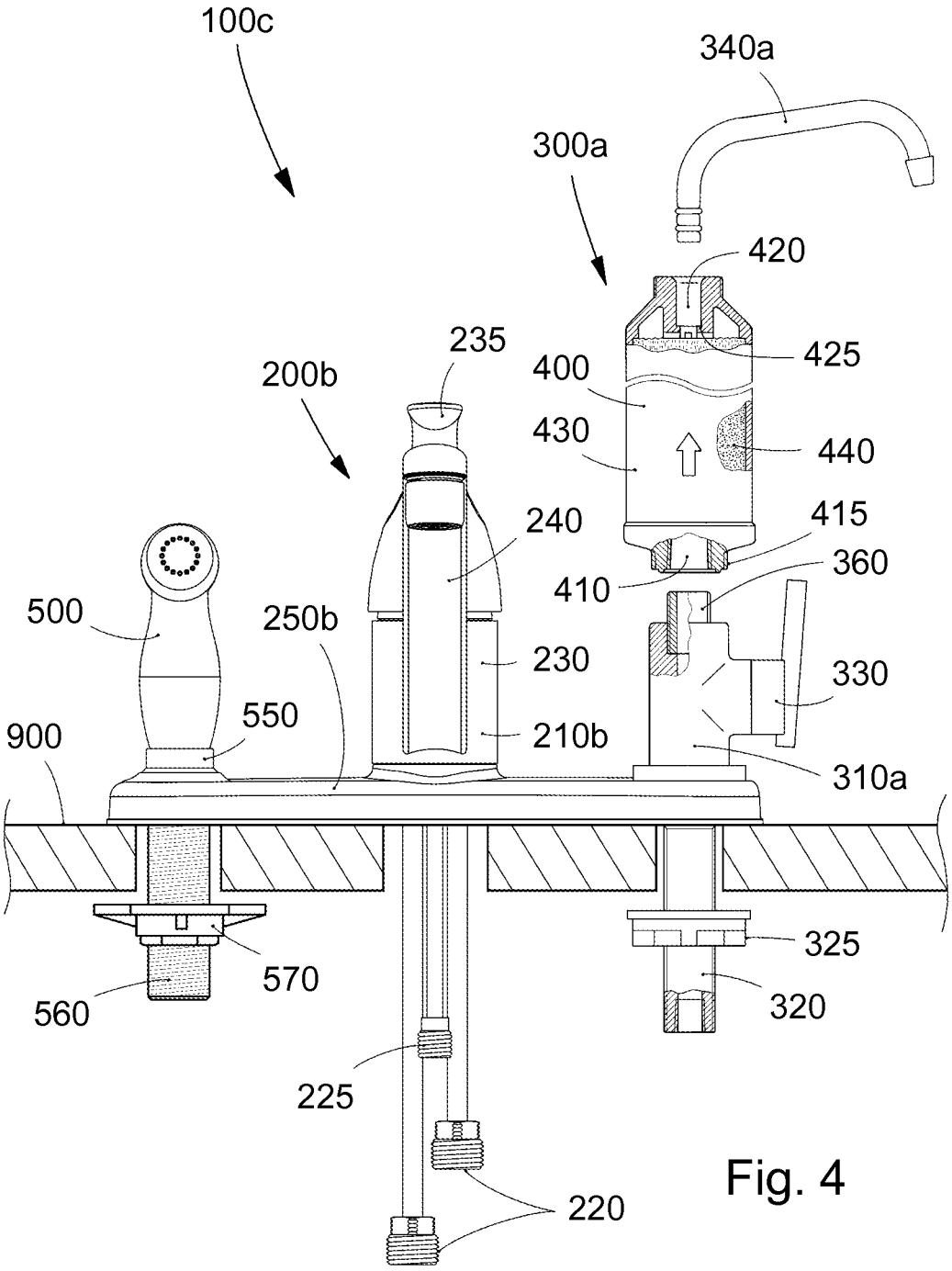
FIG. 4 is an elevational schematic view of an alternative sink faucet assembly including a filter faucet and a sink sprayer, according to the invention.

An alternative exemplary embodiment of the inventive sink faucet assembly is shown in FIG. 4. The sink faucet assembly 100*c* is shown mounted on a sink or similar countertop surface 900 in a manner common for a standard sink faucet. The inventive sink faucet assembly 100*c* is similar to that shown in FIG. 2 with exception for the notable addition of a sink spray head 500, supported by the hose guide 550 attached to the sink faucet base 250*b*. The hose guide 550 may also be referred to as an escutcheon, sprayer base, or spray mount and includes a hollow threaded shank 560 and a corresponding mounting nut 570. The standard single-handle kitchen sink faucet 200*b* is provided with an additional water conduit extending below to supply the spray head 500. The additional conduit is ended with a threaded fitting 225 for a spray hose connection. A spray hose (not shown) will fluidly connect the sprayer conduit fitting 225 to the spray head 500, through the hollow shank 560 of the hose guide. The hose guide 550 and the filter faucet body 310*a* are preferably removably engaged with the sink faucet base 250*b*. The hose guide shank 560 and the filter faucet shank 320 are operatively used for securely fastening the improved sink faucet assembly 100*c* to the mounting surface 900. The removable engagement of the filter faucet body 310*a* and the hose guide 550 with the sink faucet base 250*b* allows that the filter faucet 300*a* and the sink spray head 500 may be installed in inverted arrangement, if desired. The sink faucet 200*b* being shown in FIG. 4, which is fixed to the base 250*b* and manually operated by handle 235 may be operated in any number of ways known in the art, including for example electronic sensing devices or a solenoid. Similarly, the filter faucet body 310*a*, which has a generally standard design may be implemented with electronic devices, for example a water quality indicator or the like, for example such as those taught in U.S. Pat. No. 7,353,838 or 7,743,788.

It is understood for those skilled in the art that FIG. 4 may alternatively depict a kit of parts connectedly arranged for a sink faucet assembly according to the invention, which includes an escutcheon mount 250*b*, a single-handle water-mixing sink faucet 200*b*, a water filter faucet 300*a* having a filter in the form of a disposable inline water filter 400, and a sink sprayer 500 with an associated hose guide 550.

Figure 5:
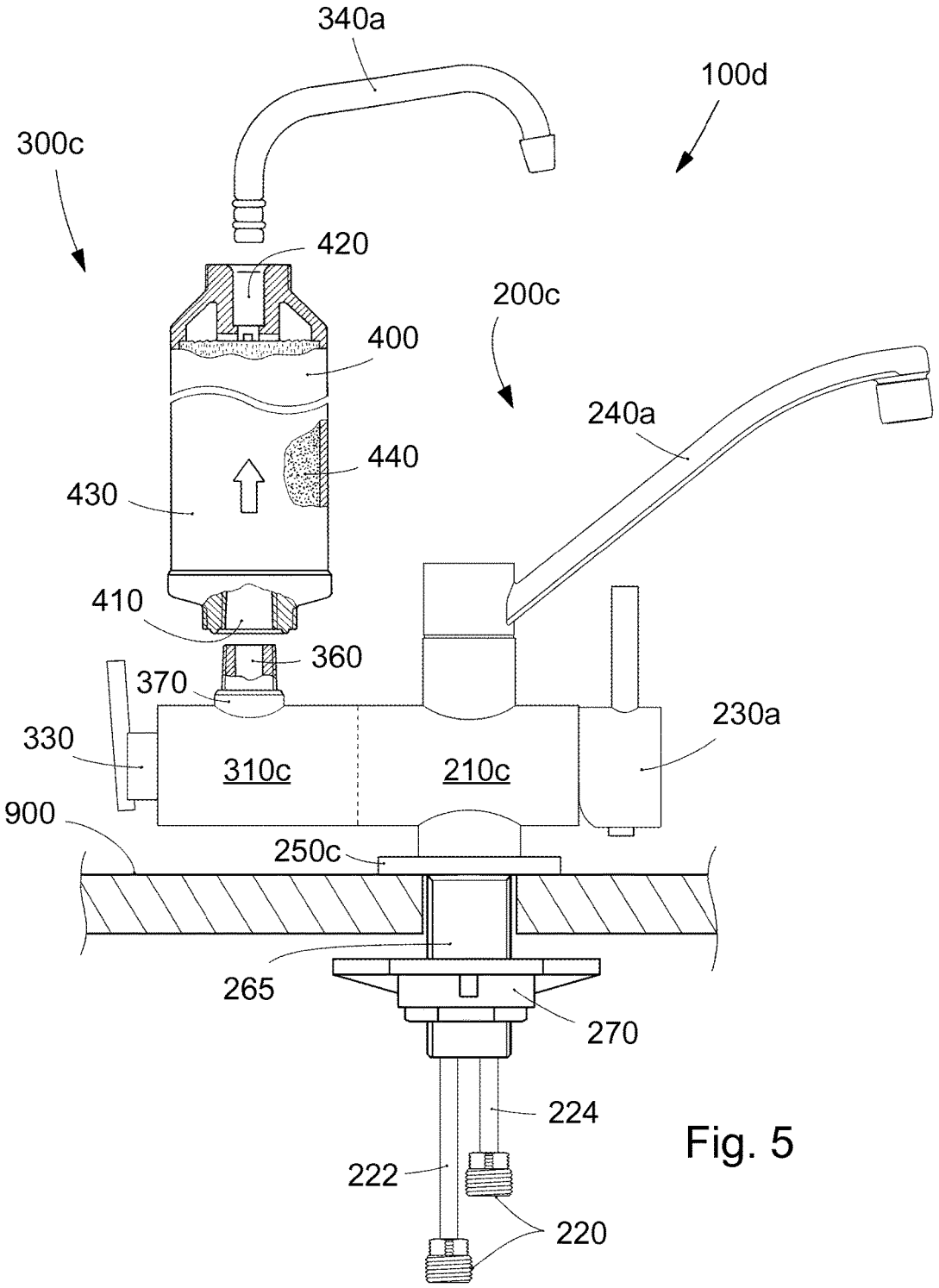
FIG. 5 is an elevational schematic view of an alternative sink faucet assembly including a filter faucet according to the invention.

In FIG. 5, the improved sink faucet assembly includes a sink faucet 200*c* having a one-hole mounting configuration, and a second faucet 300*c* configured as a filter faucet. As shown, the sink faucet body 210*c* and the filter faucet body 310*c* are joined together into a single unit. An escutcheon or flange 250*c* and a wing mounting nut 270 are configured with the faucet shank 265 to mount the whole unit into a sink deck opening. The sink faucet valve generally indicated by 230*a* is mounted within the sink faucet body 210*c* and the filter faucet valve 330 is mounted within the filter faucet body 310*c*. A valve handle (not designated) is operably attached to each valve for regulating and stopping water flow from the faucet body to the sink spout 240*a* and to the filter faucet outlet 370. The filter faucet outlet 370 is configured and adapted to support and hold in place the filter cartridge 400. In this embodiment as shown, the outlet 370 is ended with an externally threaded nipple 360, which is operatively engaged with the filter cartridge 400 inlet end 410. The filter cartridge 400, which is operatively engaged with the filter faucet outlet 370, is identical as shown and described in FIG. 2. Water is supplied to the faucet assembly 100*d* in a conventional manner via hot and cold water conduits 222 and 224 having threaded fittings 220. It is understandable for those skilled in the art that hot water from conduit 222 is channeled through the sink faucet body and mixing valve 230*a* to the discharge spout 240*a*, which is pivotally attached to the sink faucet body 210*c*. Similarly the cold water from conduit 224 is channeled through the sink faucet body 210*c* and mixing valve 230*a* to the sink spout 240*a* and additionally through the filter faucet body 310*c* and the faucet body outlet 370 to the filter 400. The sink faucet valve 230*a* controls the water flow rate and hot and cold water mixing ratio channeled to the sink spout 240*a*. The filter faucet valve 330 controls the cold water flow to the filter cartridge 400.

Figure 6:
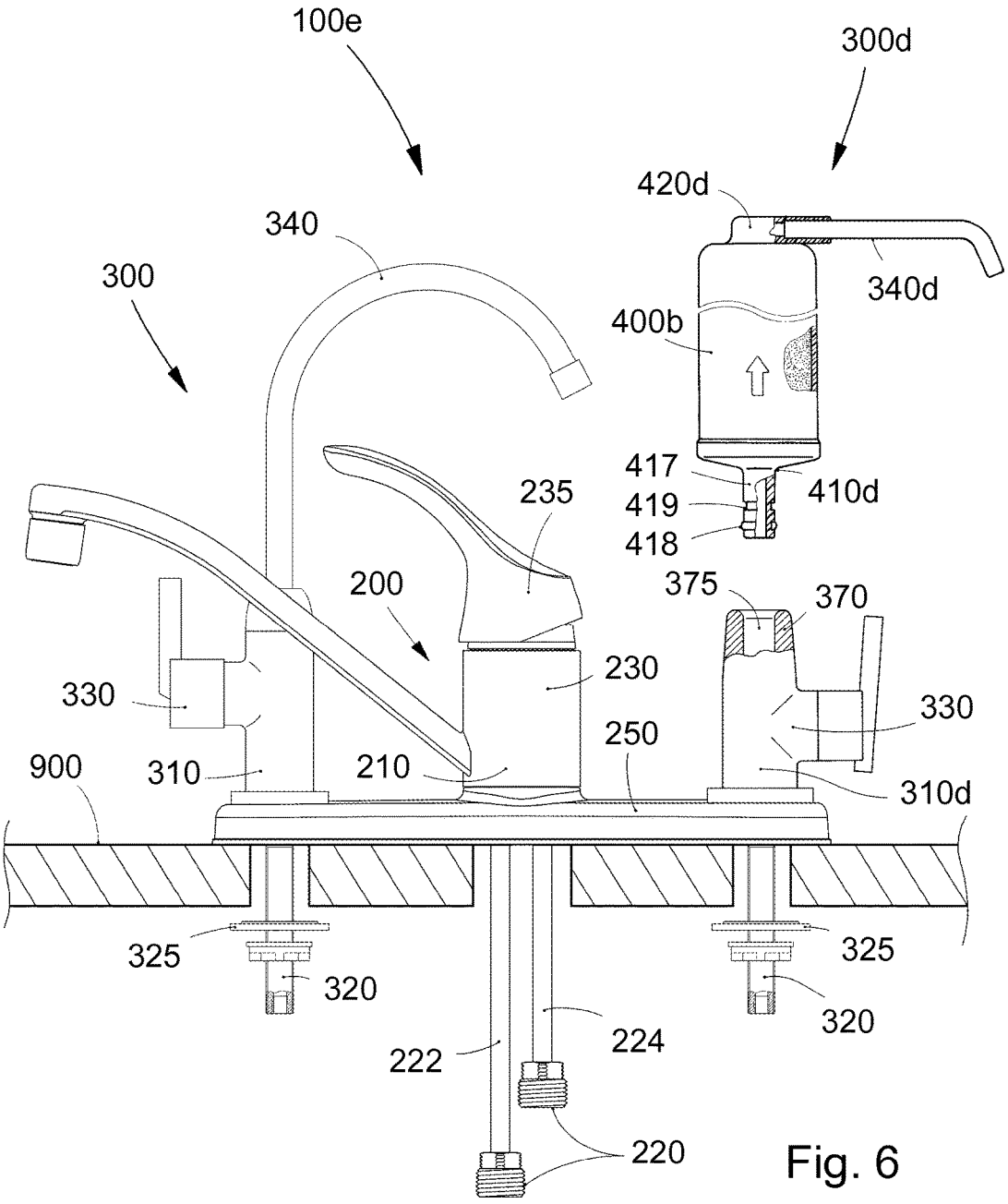
FIG. 6 is an elevational schematic view of an alternative sink faucet assembly including an alternative filter faucet and a water dispensing faucet, according to the invention.

The schematic elevational view of FIG. 6 shows an alternative sink faucet assembly 100*e* having a sink faucet 200 and water dispensing faucet 300 similar to that shown and described in FIG. 1. Except that the water dispensing faucet 300 is now shown to the left of the sink faucet 200 to provide room for the filter faucet 300*d* on the right side. The water dispensing faucet 300 being additional to the filter faucet 300*d*, may optionally dispense semi-boiled water from an undersink boiler unit (not shown). Commercial models similar to the water dispensing faucet 300 may be exemplified by the Ecopure WHEFSAT, Moen AquaSuite, or the Hydro Systems International series F1H, F3H, F9, F9AG, F9OR, and F977. The filter faucet 300*d* is similar but not identical to the filter faucet 300*a* shown and described in FIG. 2. The filter faucet body 310*d* is similar to the faucet body 310*a* of FIG. 2 with the exception that the water outlet 370 is shown having a socket fitting 375 formed for engaging a standard tubular water spout identical or similar to the spout 340 configured with the dispensing faucet 300. The inlet end 410*d* of the alternative filter cartridge 400*b* is configured as having a tubular stem 417 extending downward for cooperative fluid and watertight insertable engagement with the socket fitting 375 of the faucet body 310*d* outflow port 370. To assist with forming the fluid and watertight seal during operable engagement with the faucet body 310*d* socket fitting 375, the tubular stem 417 of the inlet end 410*d* of the filter cartridge 400*b* may be provided with an annular seal 418 and groove 419. The groove 419 may optionally include an additional seal or o-ring. The seal may be resilient plastic, a resilient elastomer o-ring, or any other means common in the art for providing frictional engagement and a watertight seal for a cylindrical contact surface. With the cylindrical tubular stem 417 and seal 418, the disposable filter cartridge 400*b* may be swivably and removably engaged with the faucet body 310*d*. The filter cartridge outlet port 420*d* may be arranged horizontally and is shown operably engaging the water spout 340*d*, which are together configured to convey filtered water from the filter cartridge.

Figure 7:
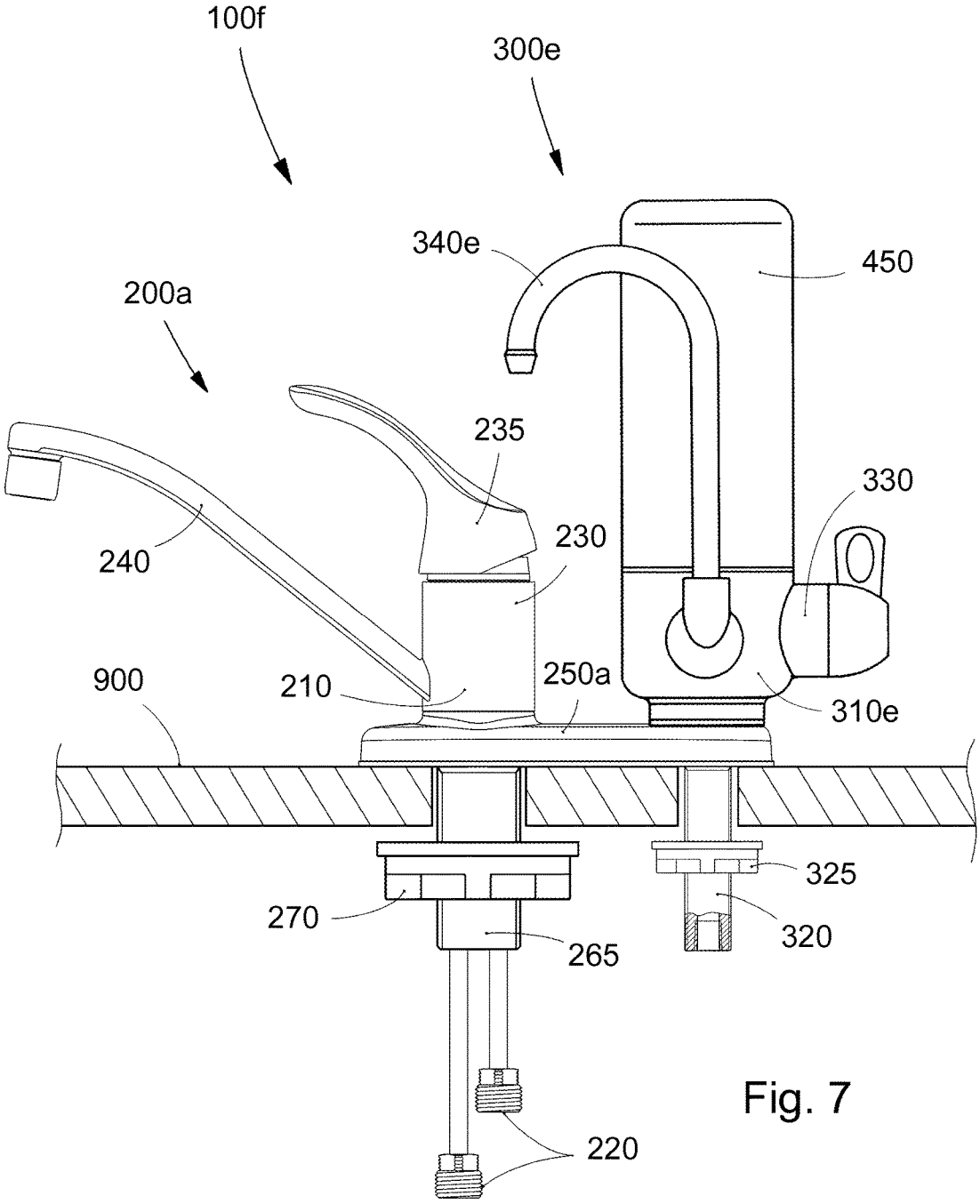
FIG. 7 is an elevational schematic view of an alternative sink faucet assembly including an alternative filter faucet, according to the invention.

FIG. 7 presents an alternative sink faucet assembly 100*f* similar to that shown and described in FIG. 3 with exception for the filter faucet 300*e*. The filter faucet 300*e* is shown having a base 310*e*. The filter faucet base 310*e* has a hollow faucet shank 320 extending below similar to that shown and described in FIGS. 2 and 3. The filter faucet base 310*e* further has a valve 330 disposed therein and a water spout 340*e* attached thereto. With the water spout 340*e* attached to the side of the faucet base 310*e*, a filter cartridge 450 may be attached to the top of the base 310*e*. The filter cartridge 450 may be similar to the type typically used with faucet mount filters and countertop filters known in the art. The filter cartridge may be optionally enclosed by a decorative cap for aesthetic purposes if desired (not shown). A filter element or cartridge within a watertight housing as known in the art (not shown), may optionally be used as a component for the filter faucet.

Figure 9:
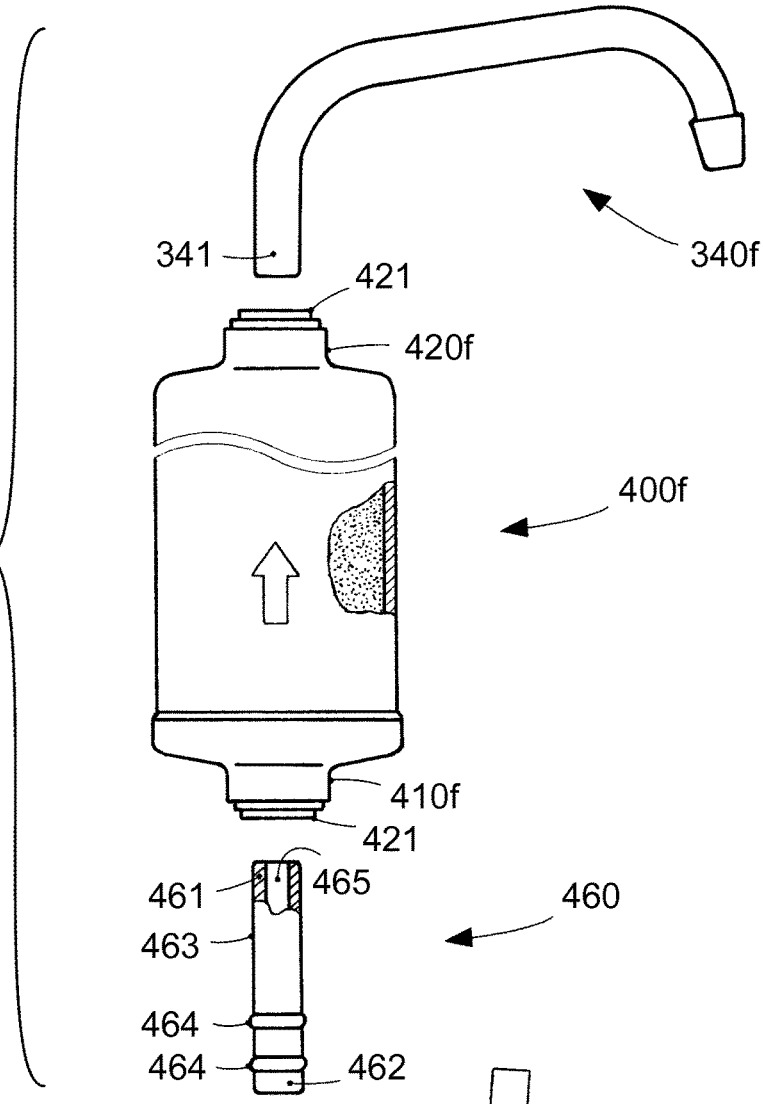
FIG. 9 is an exploded view showing a replacement kit for an alternative water filter faucet, which may be coupled with the water faucet body shown in FIG. 8 and FIG. 6.
Figure 8:
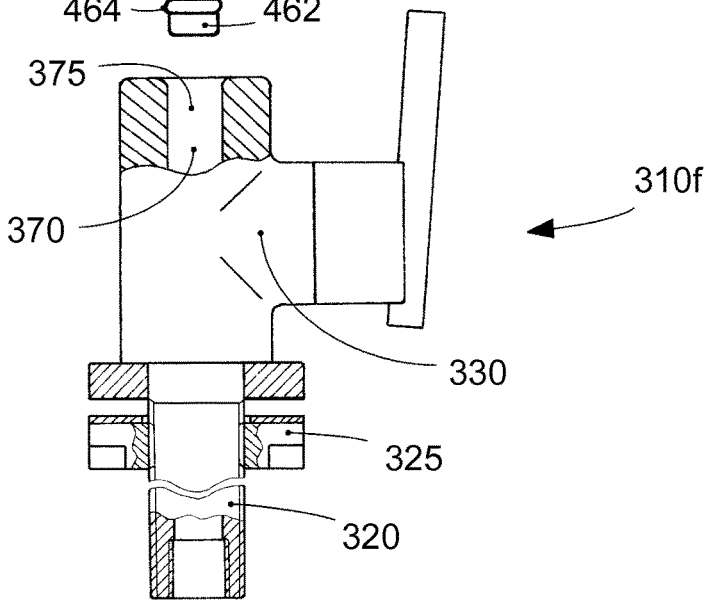
FIG. 8 is an elevational schematic view partially in section, of a common water faucet body, which may be coupled with the sink faucet base, according to the invention.

FIG. 8 depicts a filter faucet body 310*f* and FIG. 9 depicts a water filter kit, which may together form a filter faucet assembly that may be easily incorporated into a sink faucet assembly, according to the present invention. The filter faucet body 310*f* is similar to that shown and described in FIG. 6 except that it is shown in an unmounted state as an individual component separate from the sink faucet base 250.

The water filter kit in FIG. 9 includes an inline water filter cartridge 400*f*, a spout 340*f*, and a tubular stem adapter 460, which together constitute the water filter kit. The water filter kit may be disengaged from the filter faucet body 310*f*, replaced, and reinstalled as a single assembled unit. The inline water filter cartridge 400*f* has an inlet end 410*f* at the bottom and an outlet end 420*f* at the top. The inlet and outlet end 410*f* and 420*f* respectively, each preferably but not necessarily comprise a push-to-connect tube fitting 421 generally well known in the art. The push-to-connect tube fitting 421 at the filter cartridge outlet end 420*f* may operably receive and fluidly engage the inlet end 341 of the spout 340*f*, especially when the spout 340*f* is made of an FDA approved plastic tube material such as polysulfone, Polyoxymethylene (Acetal, Celcon), polypropylene, polyethylene, or similar material known in the art. The push-to-connect tube fitting 421 at the filter cartridge inlet end 410*f* may operably receive the proximal end 461 of the stem adapter 460. The push-to-connect tube fittings 421 are also known in the art as quick-connect fittings.

The stem adapter 460 of FIG. 9 preferably formed from Polyoxymethylene (Acetal, Celcon), is shown in partial cross-sectional view having an axially elongated tubular form as a cylindrical stem having two ends and a fluid conduit 465 therebetween. One end of the stem adapter 460 is the proximal end 461 for connecting with the filter cartridge 400*f* fluid inflow port 410*f*. The other end of the stem adapter 460 is the distal end 462 situated generally opposite the proximal end 461 and being fluidly connected by the fluid passage 465 therebetween. The proximal end 461 has a smooth outer contact surface 463 for a push-in connection with the tubular quick-connect fitting 421 of the filter cartridge fluid inflow port 410*f*. The distal end 462 is similarly in tubular form having a smooth outer surface and two sealing rings 464. The distal end 462 is configured to be slidably inserted in a push-in manner directly into the faucet outlet 370 socket fitting 375 for removable, swivable, and frictional watertight engagement.

It is understood that elements of the subject matter provided herein may have alternative forms without departing from the scope of the invention and may be provided in any number of configurations. For example, the single-handle sink faucet 200 described in FIGS. 1, 2, 3, 6, and 7 may be optionally configured as having a pull-out spray head incorporated into the faucet spout. A second example being that the water dispensing faucet may be optionally configured as having one or two spouts and two valves, one valve for controlling semi-boiled water and the second valve for controlling filtered water.

Many inherent benefits of this invention can now be appreciated. For example:

The improved sink faucet assembly combines a common single-handle faucet with a water filter faucet to concurrently provide both hot and cold mixed water and filtered water.

The improved sink faucet consumes the same amount of countertop sink space as a generic sink faucet while simultaneously increasing functionality.

The improved sink faucet assembly makes efficient use of standard hole patterns in typical sinks and countertops without the need for additional or customized openings.

An improved inline filter may be utilized as a reliable component of a water filter faucet, that is readily replaceable without tools and water spillage.

Multiple separate devices have been combined into a single assembled unit comprising a sink faucet, water filter faucet, a sink sprayer, and/or a semi-boiled water dispenser; thereby increasing functionality, decreasing installation costs, and saving sink or countertop mounting space.

The shanks of the sink sprayer and the filter faucet are used to secure the sink faucet assembly to the sink countertop, thereby using fewer parts for the combined unit and decreasing costs.

Use of an inline water filter on the countertop allows the water to be filtered at atmospheric pressure, which decreases the potential of water leakage while eliminating the design complexity and costs associated with a pressurized watertight housing.

What is claimed is:

1. A faucet assembly for a sink comprising:

a faucet valve assembly having a faucet valve body with inlets connected to respective sources of hot and cold water, an outlet, and a valve intermediate said inlets and said outlet movable between an open position and a closed position to control the flow and mixing of hot and cold water, said faucet valve body being mounted within a hole through an escutcheon fixed to the sink;

an inline water filter faucet assembly including a filter valve, a filter body, and a tubular spout;

said filter valve including a filter valve body, an inlet port connected to a source of cold water, an outlet port at an upper end, and a valve intermediate said inlet port and said outlet port movable between an open position and a closed position to control the flow cold water, said filter valve body being mounted within a hole through said escutcheon with said outlet port disposed above said escutcheon;

said filter body having an internal filter intermediate an inflow port at a lower end and an outflow port at au upper end, said filter body being disposed vertically above and mounted to said filter valve body with said inflow port fluidly communicating with said outlet port, said outflow port defining a cylindrical socket; and, said tubular spout having an upstream cylindrical inlet end configured to mate with said socket and be held in fluid communication with said outflow port when inserted into said socket opening and a downstream outlet end for discharging filtered cold water.

2. The faucet assembly according to claim 1 further including a third device connected to a source of water mounted to the escutcheon selected from the group consisting of a sink sprayer, a soap dispenser, and a hot water dispenser.

3. The faucet assembly according to claim 1 wherein the filter body is a disposable inline water filter.

4. The faucet assembly according to claim 1 wherein the filter body has a threaded inflow port and the filter valve body has a threaded outflow port configured for cooperative mating engagement.

5. A faucet assembly particularly for kitchen sinks, comprising in combination:

(a) a first member being generally a single-handle sink faucet having a faucet body including an escutcheon mount attachable to a kitchen sink, first and second fluid connections for connecting the faucet to hot and cold water supplies, and a valve assembly including a water delivery spout and an operating handle for mixing the hot and cold water and for controlling water flow through the spout; and (b) a second member being operatively engaged with said escutcheon mount of the first member, said second member being generally a water filter faucet having a body attachable to said escutcheon mount and including a faucet shank configured to affix said second member to the kitchen sink or countertop through an opening in the escutcheon mount, the second member constituting a water filtration device comprising a filter faucet body, a spout for discharging filtered water, and a water filter disposed in fluid communication between said filter faucet body and said spout, the water filter being a disposable inline water filter, the inline water filter having an outflow port comprising a cylindrical inner wall and an abutment supporting and limiting the depth of insertion of an inlet end of said spout.

6. The faucet assembly according to claim 1 further including an adapter coupling the filter body to the filter valve body.

7. The faucet assembly according to claim 6 wherein said adapter is an elongated hollow tubular stem configured and sized for fluidly sealingly and frictionally engaging, and slidably attaching said filter body to said filter valve body in a generally push-in manner.

8. A faucet assembly kit for a sink comprising:

(a) an escutcheon mount for attachment to a sink having at least one opening therein;

(b) a single-handle water-mixing faucet assembly attached to said escutcheon mount having means to connect said water-mixing faucet to a source of hot and cold water; and, (c) a filter faucet including a filter faucet valve having means to connect said filter faucet to a source of cold water and having a shank extending through the opening in said escutcheon mount position said filter faucet therein and an outlet port with an upward-facing opening, a filter faucet body disposed above and removably mounted to said filter valve having an internal filter intermediate an inflow port with a downward-facing opening at its lower end for fluidly communicating with said outlet port and an outflow port at its upper end defining a cylindrical socket, and a filter faucet spout removably mounted in said socket for discharging filtered water.

9. The kit of claim 8 wherein the filter is disposed between the filter faucet body and the filter faucet spout.

10. The kit of claim 9 wherein the filter faucet body is a disposable inline water filter.

11. The kit of claim 8 further including an elongated hollow tubular stem configured and sized for fluidly sealingly and frictionally engaging, and slidably attaching said filter faucet body to the filter faucet valve in a generally push-in manner.

12. The faucet assembly according to claim 1 wherein said outlet port of said filter valve body extends upwardly and has upward-facing opening, said inflow port of said filter body extends downwardly and has a downward-facing opening, and said inflow port and said outlet port cooperatively mating to provide fluid communication therebetween.

13. The faucet assembly according to claim 1 wherein said escutcheon is integral with said faucet valve body.

14. The faucet assembly according to claim 1 wherein said filter body is removable from said filter valve and said tubular spout is removable from said filter body.

15. The faucet assembly according to claim 1 wherein said socket opening extends vertically and has an upward-facing opening and said upstream cylindrical inlet end of said spout is friction fit vertically within said opening.

16. The kit of claim 8 further including a sink sprayer or a semi-boiled water dispenser attachable to said escutcheon through an opening therein.

17. The kit of claim 8 wherein said escutcheon mount is integral with said faucet assembly.

18. The kit of claim 8 wherein said socket extends vertically and has an upward-facing opening and said spout has an upstream cylindrical inlet end friction fit vertically within said socket.

* * * * *